United States Patent [19]

Sugimoto et al.

[11] Patent Number: 4,963,476

[45] Date of Patent: Oct. 16, 1990

[54] SILVER HALIDE PHOTOGRAPHIC MATERIAL

[75] Inventors: Tadao Sugimoto; Masakazu Yoneyama, both of Kanagawa, Japan

[73] Assignee: Fuji Photo Film Co., Ltd., Kanagawa, Japan

[21] Appl. No.: 248,011

[22] Filed: Sep. 23, 1988

[30] Foreign Application Priority Data

Sep. 25, 1987 [JP] Japan ..... 62-239033

[51] Int. Cl.[5] ..... G03C 1/12; G03C 1/28

[52] U.S. Cl. ..... 430/574; 430/139; 430/572; 430/576; 430/631; 430/635; 430/636

[58] Field of Search ..... 430/139, 570, 572, 574, 430/576, 631, 635, 636, 573

[56] References Cited

U.S. PATENT DOCUMENTS

| | | | |
|---|---|---|---|
| 2,865,744 | 12/1958 | Friedman et al. | 430/139 |
| 3,622,316 | 11/1971 | Bird et al. | 430/574 |
| 4,040,825 | 8/1977 | Steiger et al. | 430/570 |
| 4,543,308 | 9/1985 | Schumann et al. | 430/139 |
| 4,551,424 | 11/1985 | Ikeda et al. | 430/558 |
| 4,574,115 | 3/1986 | Adachi et al. | 430/522 |
| 4,820,606 | 4/1989 | Miyasaka et al. | 430/139 |

FOREIGN PATENT DOCUMENTS 0270079 6/1988 European Pat. Off. .

OTHER PUBLICATIONS

Patent Abstracts of Japan, vol. 11, No. 340 (P-634) [2787], Nov. 7, 1987-Abstract of Japanese Patent Application Ser. No. 62-123454.

*Primary Examiner*—Richard L. Schilling

*Attorney, Agent, or Firm*—Sughrue, Mion, Zinn, Macpeak & Seas

[57] ABSTRACT

A silver halide photographic material comprising a support having thereon at least one silver halide emulsion layer containing at least $1.0\times10^{-4}$ gram equivalent of an anionic surface active material as anion per gram of a hydrophilic dispersion medium in the emulsion layer, the material having dispersed in the emulsion layer a light-collecting dye that has an emission band overlapping at least partially with the optical absorption band of a spectral sensitizing dye on a silver halide grain present in the emulsion layer, the light-collecting dye having an emission quantum yield of at least 0.1 at a concentration of $10^{-4}$ mol/dm$^3$ in dry gelatin at room temperature, with the proviso that the light-collecting dye and the spectral sensitizing dye may be the same compound.

18 Claims, No Drawings

SILVER HALIDE PHOTOGRAPHIC MATERIAL

FIELD OF THE INVENTION

The present invention relates to a novel silver halide photographic material. More particularly, it relates to a silver halide photographic material whose photographic sensitivity is markedly improved by incorporating an anionic surface active material in a comparatively high concentration into a silver halide light-sensitive material containing a luminescent dye.

This invention relates to a basic technique applicable to all types of silver halide photographic materials including negative, positive, and reversal type black-and-white and color photographic materials.

BACKGROUND OF THE INVENTION

Spectral sensitization of silver halides with sensitizing dyes is a well-known technique. Generally employed dyes for spectral sensitization include methine dyes, such as cyanine, merocyanine, complex cyanine, and complex merocyanine dyes, etc. These dyes may be used in combination for the purpose of expansion of a color sensitive wavelength region or supersensitization.

Any of these sensitizing dyes is required to have absorbability onto silver halide grain surfaces to function as an electron injection type dye. On the other hand, however, it is known that the sensitizing dyes have certain limits in adsorption to silver halide grain surfaces, and adsorption to saturation or near saturation often results in serious desensitization (inherent desensitization), as described, e.g., in W. C. Lewis et al., *Photographic Science and Engineering,* Vol. 13, p. 54 (1969). Moreover, surface coating of silver halide grains with sensitizing dyes is sometimes accompanied by problems, such as development inhibition. In accordance with the present invention, therefore, the individual silver halide grains exhibit an extremely low rate of absorption (utilizing efficiency) of incident photons in the spectral sensitization region.

Bird et al. proposed to increase the quantity of absorbed photons by having plural dyes adsorbed on silver halide to form multiple layers as disclosed in U.S. Pat. No. 3,622,316 or by having sensitizing dye molecules containing plural cyanine chromophoric groups adsorbed on silver halide as disclosed in U.S. Pat. Nos. 3,622,317 and 3,976,493, to thereby effect sensitization utilizing Förster type excited energy transfer. However, these techniques still suffer from the aforesaid limitations in adsorption surface area and the disadvantages due to inherent desensitization, and thus attain virtually no substantial positive effects.

Steiger et al. proposed a sensitization technique in which a fluorescent dye, such as a cyanine dye, a xanthene dye, etc., is chemically bonded to colloidal molecules of a dispersion medium, such as gelatin. The fluorescent dye bound to, e.g., gelatin, excites the dye adsorbed on the silver halide surfaces or a spectral sensitizing dye of a different kind through Förster type energy transfer (cf. *Th. Forster, Disc. Faraday Soc.,* Vol. 27, 7 (1959)) or optical absorption of luminescence emitted from the dye bound to gelatin as disclosed in *Photo. Sci. Eng.,* Vol. 27, 59 (1983) and JP-A No. 51-117619 (the term "JP-A" as used herein means an "unexamined published Japanese patent application"). This technique differs from the system of Bird et al. in that a dye which is not directly adsorbed on silver halide grains also contributes to sensitization. However, since the sensitizing dye to be dispersed in a medium according to the method of Steiger et al. naturally exhibits strong absorbability, a part of the dye bonded to gelatin is also adsorbed directly on the silver halide grains and thereby acts as an energy acceptor. As a result, it is generally difficult to realize ideal overlapping of the luminescence band by the non-adsorbed dye and the absorption band by the adsorbed dye.

This difficulty greatly bars highly efficient energy transmission, because energy transmission essentially requires, in principal, an overlap of a luminescence band and an absorption band, whether it is effected by Förster type energy transfer or reabsorption of luminescence. Further, when the dye to be used is of such a type that adsorption onto the silver halide grains brings about desensitization, the above-described method cannot be applied. Further, this method involves complicated steps, such as syntheses or purification of a dye capable of being bonded to a dispersion medium, entailing greatly increased production cost.

Moreover, in carrying out the above-described method, it is necessary to use a light-collecting dye in high concentration. However, the rate of reaction between the dye and dispersion medium molecules has its limit. Even if a high rate of reaction is achieved, functional groups for hardening would be lost upon reacting, so that a sufficient degree of hardening is hardly obtained. These restrictions impose a practical limit on the concentration of the dye to be added.

Further, the choices available for synthesis of or selection of the aforesaid luminescent dye materials capable of being bonded to a dispersion medium are far narrower in scope than that permitted in the technique of the present invention in which a desired amount of a water-soluble luminescent dye is merely added and dispersed in a hydrophilic medium.

The luminescent dye is required to almost completely decolorize during photographic processing. However, when the dye is chemically bound to the medium as in the above-described method, complete decolorization is virtually impossible or requires a special processing step.

The above-described sensitization method of utilizing dye adsorption in multiple layers and the method of using a dye bound to a binder both lack the ability to increase sensitization efficiency by separating the function of a spectral sensitizing dye (electron injection type) in an adsorbed state from the function of a light-collecting dye of the energy transmission type. These methods are also disadvantageous in that a complicated synthesis route for making the dye is involved, or general development processing is inapplicable.

Under these circumstances, the present inventors have developed a technique which, as shown in JP-A Nos. 63-138341 and 63-138342 comprising clearly separating the light-collecting function of a luminescent dye and the function of sensitization on the surface of silver halide grains, thereby achieving a marked improvement in the efficiency of sensitization by light collection and great facility in the decoloration of a light-collecting dye without requiring any special processing step.

This technique of sensitization by light collection, however, still suffers the problem of "density-dependent light extinction" which occurs when the addition of a light-collecting dye exceeds a certain limit. At a high concentration of light-collecting dye, the energy of its excitation is absorbed by the extinction center and gradual desensitization occurs. Another problem is the desensitization that occurs when part of the light-collecting dye is adsorbed on the surface of silver halide grains.

As described above, the problems of density-dependent light extinction and the desensitization due to adsorption of a light-collecting dye are yet to be solved in connection with prior art techniques for sensitization of silver halide light-sensitive materials by light collection and there has been a strong need to effectively solve these problems.

SUMMARY OF THE INVENTION

Accordingly, an object of the present invention is to provide a silver halide light-sensitive material that is free from the causes of densensitization accompanying sensitization by light collection and which exhibits the desired sensitizing effect even in the presence of a high concentration of light-collecting dye so as to excel in performance in comparison to the prior art technique of sensitization by light collection.

As a result of intensive studies conducted in order to attain the above and other objects and advantages of the present invention, the present inventors found that by incorporating a comparatively high concentration of an anionic surface active material into a silver halide light-sensitive material containing a luminescent dye, the sensitivity of a system which has not always been able to attain satisfactory sensitization in the presence of a high concentration of light-collecting dye due to inherent causes of desensitization could be fully restored, resulting in markedly improved sensitization, thereby solving the aforementioned problems of the prior art.

Thus, the above-stated and other objects of the present invention can be attained by a silver halide light-sensitive material comprising a support having thereon at least one silver halide emulsion layer containing at least $1.0\times10^{-4}$ gram equivalent of an anionic surface active material as anion per gram of a hydrophilic dispersion medium in the emulsion layer, said material having dispersed in said emulsion layer a light-collecting dye that has an emission band overlapping at least partially with the optical absorption band of a spectral sensitizing dye on a silver halide grain present in said emulsion layer said light-collecting dye having an emission quantum yield of at least 0.1 at a concentration of $10^{-4}$ mol/dm$^3$ in dry gelatin at room temperature, with the proviso that the light-collecting dye and the spectral sensitizing dye may be the same compound.

DETAILED DESCRIPTION OF THE INVENTION

The anionic surface active material to be used in the present invention is preferably represented by the following general formula (I) or (II):

$$R—A_1—Z \qquad (I)$$

wherein R signifies a hydrocarbon residue having 6–24 carbon atoms, such as $C_6H_{13}$, $C_{12}H_{25}$, $C_{16}H_{33}$, $C_{18}H_{35}$-

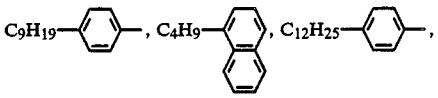

$C_8F_{17}$—, and $H(C_2F_4)_n—CH_2—$ (n=2–5), or a perfluoroalkyl or alkenyl group having 3–16 carbon atoms (including such groups having a single hydrogen atom on ω-position); $A_1$ is a linkage group, and preferred examples of $A_1$ include:

$$—O(CH_2)_n— \ (n=1\text{–}6),\ —\underset{\underset{CH_3}{|}}{CON}CH_2CH_2—, \qquad (II)$$

$$—O(CH_2CH_2O)_m(CH_2)_n \ (m=1\text{–}30,\ n=1\text{–}4),$$

$$—O—\underset{\underset{O}{\|}}{C}—\underset{\underset{\underset{OR}{|}}{C=O}}{CH_2CH}— \ (R=6\text{–}12C),\ —SO_2\underset{\underset{CH_3}{|}}{N}CH_2CH_2—,$$

$$—NHCH_2CH_2—,\ —CONH(CH_2)_3—,\ —SO_2NHCH_2—,$$

$$—OCH_2\underset{\underset{OH}{|}}{C}HCH_2—,\ OCH_2\underset{\underset{OH}{|}}{C}HCH_2NHCH_2CH_2—,$$

$$—CONHCH_2—,\ —SCH_2CH_2—,\ \text{and}\ —\underset{\underset{O}{\|}}{C}OCH_2CH_2—;\ \text{and}$$

Z signifies —COOM, $—SO_3M$, $OSO_3M$, $—\overset{\overset{O}{\|}}{O}P(OM)_2$, $(—O)_2\overset{\overset{O}{\|}}{P}—OM$, $—\overset{\overset{O}{\|}}{P}(OM)_2$, or $=\overset{\overset{O}{\|}}{P}—OM$ (wherein M is a acation such as hydrogen, alkali metal or ammonium salt);

$$R—A_2—(M_1)m—(M_2)n—X$$

wherein R has the same meaning as R in general formula (I); $A_2$ is a divalent linkage group; $M_1$ signifies an ethylenic monomer unit having an anionic group selected from the groups defined for Z in general formula (I); $M_2$ is the same as $M_1$ or $M_2$ signifies an ethylenic monomer unit (in $M_2$ more than two kinds of monomer unit may be present); m and n each represents the average number of $M_1$ and $M_2$ monomers, respectively, with m being at least 1 and n being 0 or at least 1, and with m+n being preferably in the range of 2–30, more preferably 2–15; m/n denotes the ratio of m to n such that the anionic surface active material represented by general formula (II) is water-soluble or water-dispersible; X is a monovalent group such as a hydrogen atom, a halogen atom, an initiator residue or a chain transfer agent residue.

In general formula (II), $A_2$ signifies a divalent linkage group which is preferably represented by the following general formula (III):

$$—(R_1)_a—(Y)_b— \qquad (III)$$

wherein $R_1$ signifies a substituted or unsubstituted divalent hydrocarbon group; Y signifies a divalent group that can be used as a telogen such as S, O, NH or COO which has a chain transfer constant of the order of $10^{-2}$; a denotes an integer of 1; b denotes 0 or an integer of 1, provided that when b=0, X in the general formula (II) signifies hydrogen or halogen. Preferred example of $A_2$ include:

$$—CH_2S—,\ —CH_2CH_2S—,\ —CH_2SO_2—,\ —CH_2CH_2SO_2—,$$

-continued

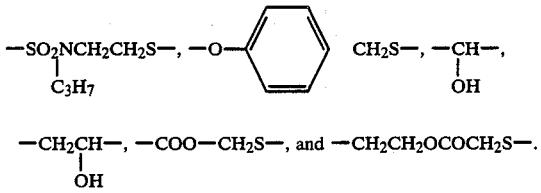

Examples of $M_1$ in general formula (II) include acrylic acid, methacrylic acid, styrenecarboxylic acid, styrenesulfonic acid, 2-acrylamido-2-methyl-propanesulfonic acid, and salts thereof such as sodium salt.

Examples of $M_2$ in general formula (II) include those given above for $M_1$ and also other ethylenic monomer units such as methyl acrylate, methyl methacrylate, acrylonitrile, acrylamide, vinyl alcohol, styrene, etc.

Anionic surfactants of general formula (I) can be synthesized by standard methods including those described by R. Oda and K. Teramura, *Syntheses and Applications of Surfactants,* Maki Shoten, 1960, and H. Horiguchi, *New Surfactants,* Sankyo Shuppan, 1975.

Anionic surfactants of general formula (II) can be synthesized by radical polymerization of ethylenically unsaturated monomers in the presence of a chain transfer agent. Suitable chain transfer agents are described by T. Ohtsu, *Radical Polymerization (Part I)* in *A Course in the Theory of Polymerization Reactions,* Kagaku Dojin, 1971. Radical polymerization may be performed by various methods such as those described by T. Ohtsu and M. Kinoshita, *Methods of Experiments on Polymer Synthesis,* Kagaku Dojin, 1972.

Anionic surfactants other than those represented by formulae (I) and (II) include vinyl-polymers or condensed type anionic polymer surfactants.

Typical examples of the anionic surface active materials that can be used in the present invention are listed below but it should of course be understood that the scope of the present invention is by no means limited to these examples.

1. $RSO_3Na$ ($R \approx C_{12}H_{25}$)
2. α-Olefinsulfonic acid salt (olefin $C_{14}H_{27}$)
3. $C_{12}H_{25}O(CH_2)_4SO_3K$ 1. $RSO_3Na$ ($R \approx C_{12}H_{25}$)

2. α-Olefinsulfonic acid salt (olefin$C_{14}H_{27}$)

3. $C_{12}H_{25}O(CH_2)_4SO_3K$

4. $C_{17}H_{33}CON(CH_3)CH_2CH_2SO_3Na$

5. 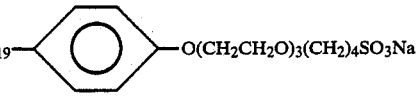

6. 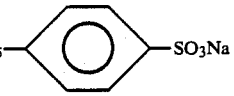

-continued

7. 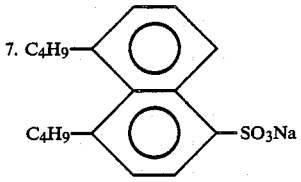

8. 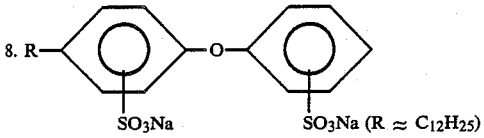

9. $CH_2COOC_8H_{17}$
$CHCOOC_8H_{17}$
$SO_3Na$

10. $C_{12}H_{25}OSO_3Na$

11. $C_{12}H_{25}OP(=O)(ONa)_2$

12. $C_{11}H_{23}CON(CH_3)CH_2COONa$

13. 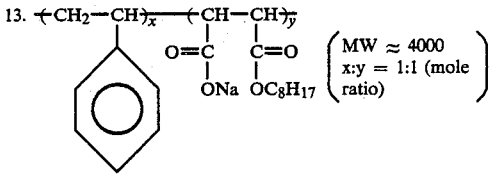

14. 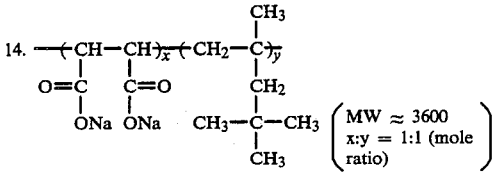

15. $C_{12}H_{25}S(CH_2CH(COOK))_3H$

16. $C_{12}H_{25}SO_2(CH_2CH(COOK))_3H$

17. 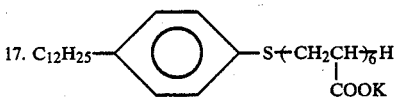

18. $C_{12}H_{25}S(CH_2CH(CN))_3(CH_2CH(COOK))_6H$

18'. $C_{11}H_{23}CH(OH)(CH_2CH(COONa))_{10}H$

19. 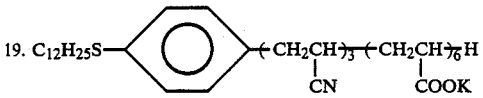

-continued

20. $C_{12}H_{25}S(CH_2CH)_3(CH_2CH)_{76}H$ (COOK)

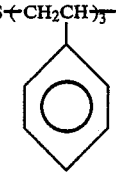

21. $C_{12}H_{25}S(CH_2C(CH_3))_{76}(CH_2CH)_{76}H$ ($COOCH_3$; $CONHC(CH_3)CH_2SO_3Na$)

22. 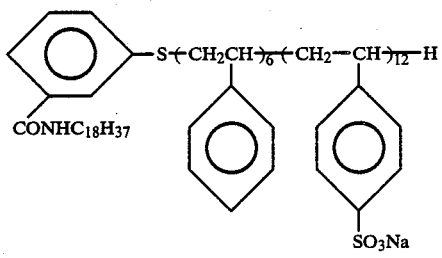

23. $C_{12}H_{25}SO_2(CH_2CH)_3(CH_2CH)_{15}H$

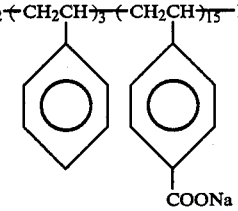

24. $C_8F_{17}CH_2CH_2S(CH_2CH)_5H$ (COOH)

25. $C_8F_{17}CH_2CH_2S(CH_2—C(CH_3))_5H$ (COONa)

26. $C_8F_{17}CONHCH_2CH_2S(CH_2CH)_3(CH_2CH)_5H$ (COONa; CN)

27. $C_8F_{17}—CH(OH)(CH_2CH)_{10}—H$ (COONa)

28. $C_9F_{17}O$ 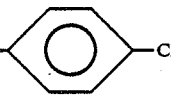 $CH_2S(CH_2C(CH_3))_5H$ (COONa)

29. $C_8F_{17}SO_3NH_4$

30. $C_8F_{17}SO_2N(C_3H_7)—CH_2COOK$

31. $C_9F_{17}O$ 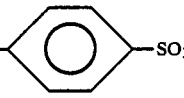 $SO_3Na$

32. $C_8F_{17}SO_2N(C_3H_7)(CH_2CH_2O)_3(CH_2)_4SO_3Na$

-continued

33. $C_8F_{17}SO_2N(C_3H_7)CH_2CH_2O—P(=O)(ONa)—ONa$

34. $H(CF_2)_6CH_2OOC—CH_2$
$H(CF_2)_6CH_2OOC—CH—SO_3Na$

35. $C_8F_{17}SO_2N(C_8H_{17})CH_2CH_2O(CH_2)_4SO_3Na$

These anionic surface active materials exhibit marked sensitizing effects in types of silver halide light-sensitive materials to be sensitized by light-collecting dyes. In this specification, the terms "luminescent dye" and "light-collecting dye" are used interchangeably. The light-collecting dye used in the photographic material of the present invention has an emission band that overlaps at least partially with the optical adsorption band of a spectral sensitizing dye attached to or adsorbed on a silver halide grain and has an emission quantum yield of at least 0.1 at a concentration of $10^{-4}$ mol/dm$^3$ in dry gelatin at room temperature. The silver halide photographic material of the present invention is characterized by having this light-collecting dye dispersed in the hydrophilic medium of a light-sensitive layer together with an anionic surface active material.

The anionic surface active material is present in an amount of at least $1.0\times10^{-4}$ gram equivalent, preferably in the range of from $1.0\times10^{-4}$ to $1.0\times10^{-2}$ gram equivalent, more preferably in the range of from $1.0\times10^{-4}$ to $1.0\times10^{-3}$ gram equivalent, most preferably in the range of from $3.0\times10^{-4}$ to $1.0\times10^{-3}$ gram equivalent, as anion per gram of the hydrophilic dispersion medium.

The light-collecting dye for use in the present invention may be partly adsorbed on silver halide grains. Light-collecting dyes will inherently exhibit their function by being present in silver halide media. However, if the light-collecting dye used in the present invention is partly adsorbed on silver halide grains, other adsorbable spectral sensitizing dyes need not be incorporated in one light-sensitive layer and there would be no problem at all if a single luminescent dye were used to serve both as a light-collecting dye and as a spectral sensitizing dye on silver halide grains. But it is more preferable to employ a light-collecting dye which is of a different kind than the spectral sensitizing dye adsorbed on silver halide grains. In this case, the light-collecting dye desirably has smaller absorbability on silver halide grains than the spectral sensitizing dye. This condition is usually met by light-collecting dyes whose adsorption at equilibrium in a 5 wt % aqueous gelatin solution containing silver bromide grains whose outer surfaces are substantially composed of {III} planes is no more than $10^{-6}$ mol/m$^2$ per unit surface area of AgBr grains at 40° C., a pH of $6.5\pm0.5$ and at a dye concentration of $10^{-4}$ mol/l in solution phase. More preferably, the adsorption at equilibrium is no more than $5\times10^{-7}$ mol/m$^2$. The amount of adsorption of dye may be determined by a method that comprises adding the dye to an emulsion containing 5 wt % of gelatin, stirring the mixture at 40° C. for 18 hours under a safety lamp, allowing the silver halide grains to settle by centrifugation, and measuring the dye concentration in the separated supernatant. The above-noted values will serve as a guide for the amount of adsorption on silver bromide grains of the light-collecting dye to be used in the present invention, and preferably similar low values are also observed with silver halides containing iodine or chlorine.

If a non-adsorbable luminescent/light-collecting dye is used, the non-adsorbable dye preferably has adequately high water solubility, for example, a solubility of at least $10^{-2}$ mol in 1 l of water at 25° C. and a pH of 7.0.

Light-collecting dyes having such high water solubility are generally adsorbed to a smaller extent on silver halide grains, so they can be dispersed in high concentration in the hydrophilic colloid of an emulsion layer while, at the same time, they can be removed rapidly and completely by rinsing. Thus, as used herein, the term "non-adsorbable" dye includes light-collecting which actually have slight absorbability on silver halide.

The light-collecting dye is required to have an emission quantum yield of at least 0.1, preferably not less than 0.3, and more preferably not less than 0.5, at a concentration of $10^{-4}$ mol/dm$^3$ in a dry gelatin medium at room temperature.

The emission quantum yield of the light-collecting dye in a dry film can be determined basically in the same manner as for measurement of emission quantum yields in solutions. In general, this value is obtained by a relative measurement method in which each of an incident light intensity, an extinction modulus of a sample, and an emission intensity of a sample is compared with the corresponding value of a standard substance whose absolute quantum yield is known (e.g., Rhodamine B, quinine sulfate, 9,10-diphenylanthracene, etc.) with the optical arrangements being the same. Reference can be made to, e.g., in C. A. Parker and W. T. Rees, *Analyst,* Vol. 85, p. 587 (1960) for information as to the absolute quantum yield.

The emission quantum yield of the light-collecting dye in dry gelatin can, therefore, be obtained conveniently through the aforesaid relative measurement using, as a reference substance, a dry gelatin film (a sample in sheet form) having dispersed therein a standard luminescent dye at an arbitrary concentration, whose absolute quantum yield is known. In the present invention, the absolute emission quantum yield of a standard sample in a dry film was determined as follows.

The Method of Determining the Absolute Emission Quantum Yield of a Standard Sample Fluorescent N-phenyl-1-naphthylamine-8-sulfonic acid, which does not contribute to reabsorption due to an overlap of an absorption band and an emission band was chosen as a standard dye. Gelatin containing this standard dye was uniformly coated on a transparent support and dried to prepare a standard sample having a dye concentration (in a dry film) of $10^{-2}$ mol/dm$^3$ and a gelatin coverage of 6 g/m$^2$. Thereafter, the sample was set in an integrating sphere whose inner wall had been coated with a white powder of barium sulfate. A monochromatic exciting light of 380 nm was irradiated on the sample, and the intensities of the exciting light and fluorescence were detected by a photomultiplier set at the window of the integrating sphere. At this time, a percent absorption (A) of the sample was determined by comparing the intensity of exciting light with the sample being set with that with no sample being set, as detected by the photomultiplier through a fluorescence-cut filter. On the other hand, the integrated fluorescent intensity (F') of the fluorescence from the sample was determined by using an exciting light-cut filter. Then, the intensity of a monochromatic incident light (I') was measured under the same measurement system as for F', but with neither a sample nor a filter being set. The resulting F' and I' were converted to true relative photon numbers (F and I), respectively, based on the spectral transmittance of the exciting light-cut filter, effective spectral reflectance of the integrating sphere, spectral sensitivity of the photomultiplier, and the like. An absolute fluorescent quantum yield can then be calculated from F/(I.A).

The emission quantum yields of water-soluble cyanine dyes and other typical light-collecting dyes of the invention (e.g., xanthene dyes and water-soluble cyanine dyes), in a dry gelatin film can thus be obtained by relative measurement based on the standard sample whose absolute emission quantum yield is known.

In view of the intended purpose of obtaining a wide overlap of an absorption band and an emission band, thereby increasing the energy transmission efficiency, the highly luminescent dye to be used in the present invention preferably has a sufficiently small shift of wavelength between the absorption peak and the emission peak, a so-called Stokes' shift. The Stokes' shift for increasing the energy transmission efficiency is preferably not more than 40 nm, and more preferably not more than 20 nm, at a concentration of $10^{-4}$ mol/dm$^3$ in a dry gelatin film at room temperature. A number of cyanine dyes have a sufficiently small Stokes' shift within 20 nm.

The light-collecting dye according to the present invention produces an emission band overlapping with an absorption band produced by a blue, orthochromatic, or panchromatic sensitizing dye generally employed for black-and-white or color photographic light-sensitive materials and also has a relatively small Stokes' shift as described above. From this point of view, the light-collecting dye preferably has a maximum absorption wavelength of 400 nm or more, more preferably 420 nm or more, and most preferably from 420 to 740 nm.

From the standpoint of emission quantum efficiency and Stokes' shift, xanthene type dyes and cyanine type dyes are preferred as light-collecting dyes. As for cyanine dyes, D. F. O'Brien et al. reported in *Photog. Sci. Eng.,* Vol. 18, p. 76 (1974) emission yields of various dyes as determined in solutions or other matrices, and an oxacarbocyanine derivative was found to have an emission quantum yield of 0.75 in gelatin. Further, dyes having a skeleton structure of those suitable for use as dye lasers also exemplify the dyes having high emission quantum yields. These light-collecting dyes are listed, e.g., in Mitsuo Maeda, *Laser Kenkyu,* Vol. 8, pp. 694, 803 and 958 (1980), ibid, Vol. 9, p. 85 (1981), and F. P. Schaefer (ed.), *Dye Lasers,* Springer Verlag (1973). Although many of these dyes are poor in water-solubility as a class, it is possible to render them water-soluble and non-adsorbable and thereby employable in the system of the present invention by introducing a plurality of sulfo groups or carboxyl groups into their molecular structure as proposed in the present invention.

The light-collecting dyes which can be used in the present invention are shown below in classes for illustrative purposes only and should not be construed as limiting the scope of the present invention.

I. Water-soluble cyanine or merocyanine dyes

II. Xanthene dyes

III. Acridine dyes
IV. Oxazine dyes
V. Thiazine dyes
VI. Riboflavin dyes
VII. Triarylmethane dyes
VIII. Aminonaphthalene dyes
IX. Pyrene dyes
X. Coumarin dyes
XI. Porphyrin dyes
XII. Phthalocyanine dyes Specific examples of preferred luminescent/light collecting dyes to be used in this invention are given below, but the skeletal structure, substituents, and the like shown should not be construed as limiting the scope of the present invention.

(I)

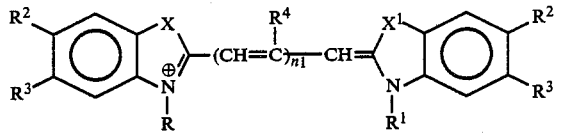

| | X | X¹ | R | R¹ | R² | R³ | R⁴ | $n_1$ |
|---|---|---|---|---|---|---|---|---|
| A-1 | O | O | $(CH_2)_4SO_3^{\ominus}$ | $(CH_2)_4SO_3Na$ | $CO_2Na$ | H | H | 1 |
| A-2 | O | O | " | " | $SO_3Na$ | H | H | 1 |
| A-3 | O | O | " | $(CH_2)_4SO_3K$ | H | $SO_3K$ | — | 0 |
| A-4 | O | O | $(CH_2)_2SO_3^{\ominus}$ | $(CH_2)_2SO_3Na$ | $SO_2(CH_2)_2SO_3Na$ | H | H | 1 |
| A-5 | O | O | " | " | $SO_2NH(CH_2)_2SO_3Na$ | H | H | 1 |
| A-6 | O | O | $(CH_2)_3CO_2^{\ominus}$ | $(CH_2)_3CO_2H$ | $O(CH_2)_3SO_3H$ | $SO_3H$ | $CH_3$ | 1 |
| A-7 | O | O | $(CH_2)_3SO_3^{\ominus}$ | $(CH_2)_3SO_3Na$ | $CONH(CH_2)_2SO_3Na$ | H | H | 1 |
| A-8 | O | O | $(CH_2)_3SO_3^{\ominus}$ | $(CH_2)_3SO_3K$ | $N(CH_2CH_2SO_3K)_2$ | H | H | 1 |
| A-9 | O | O | $C_2H_5$ | $C_2H_5$ | $SO_3Na$ | $SO_3Na$ | H | 1 |
| A-10 | O | O | $(CH_2)_2SO_3^{\ominus}$ | $(CH_2)_3SO_3Na$ | $CH_2CO_2Na$ | Cl | H | 1 |
| A-11 | O | O | $(CH_2)_4SO_3^{\ominus}$ | $(CH_2)_4SO_3H$ | $CO_2H$ | H | — | 0 |
| A-12 | O | O | " | " | H | $SO_3H$ | H | 2 |
| A-13 | O | O | " | $(CH_2)_4SO_3K$ | $SO_2)_2SO_3K$ | H | H | 3 |
| A-14 | S | S | $(CH_2)_3SO_3^{\ominus}$ | $(CH_2)_3SO_3Na$ | H | $CO_2Na$ | H | 1 |
| A-15 | S | S | " | " | $SO_3Na$ | H | $CH_3$ | 1 |
| A-16 | S | S | $(CH_2)_2SO_3^{\ominus}$ | $(CH_2)_2SO_3Na$ | $SO_2(CH_2)_2SO_3Na$ | Cl | H | 1 |
| A-17 | S | S | " | " | $CONH(CH_2)_2SO_3Na$ | H | H | 1 |
| A-18 | S | S | $(CH_2)_3CO_2^{\ominus}$ | $(CH_2)_3CO_2H$ | $O(CH_2)_3SO_3H$ | H | H | 1 |
| A-19 | S | S | $CH_3$ | $CH_3$ | $CH_2SO_3K$ | $SO_3K$ | H | 1 |
| A-20 | S | S | $(CH_2)_4SO_3^{\ominus}$ | $(CH_2)_4SO_3Na$ | H | $CO_2Na$ | — | 0 |
| A-21 | S | S | " | " | $SO_3Na$ | H | — | 0 |
| A-22 | S | S | $(CH_2)_2SO_3^{\ominus}$ | $(CH_2)_2SO_3Na$ | $SO_3Na$ | $SO_3Na$ | H | 2 |
| A-23 | S | S | $(CH_2)_2SO_3^{\ominus}$ | $(CH_2)_2SO_3Na$ | $SO_3Na$ | H | H | 2 |
| A-24 | O | S | $(CH_2)_3SO_3^{\ominus}$ | $(CH_2)_3SO_3H$ | $CO_2H$ | H | — | 0 |
| A-25 | O | S | " | " | $SO_3Na$ | H | H | 1 |
| A-26 | O | S | " | " | $SO_3Na$ | Cl | H | 1 |
| A-27 | O | S | " | $(CH_2)_4SO_3Na$ | H | $O(CH_2)_2SO_3Na$ | H | 1 |
| A-28 | O | S | " | " | H | $SO_3Na$ | H | 2 |
| A-29 | O | S | " | " | $SO_3Na$ | H | $CH_3$ | 2 |

(II)

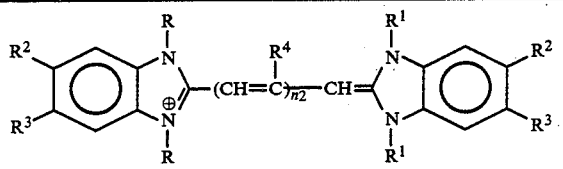

| | R | R¹ | R² | R³ | R⁴ | $n_2$ |
|---|---|---|---|---|---|---|
| A-30 | $(CH_2)_3SO_3^{\ominus}$ | $CH_2SO_3Na$ | $CF_3$ | H | H | 1 |
| A-31 | " | " | H | Cl | H | 1 |
| A-32 | " | " | $(CH_2)_4SO_3Na$ | H | H | 1 |
| A-33 | " | $CH_2CO_2K$ | $(CH_2)_4SO_3K$ | $(CH_2)_4SO_3K$ | $CH_3$ | 1 |
| A-34 | " | $(CH_2)_3SO_3K$ | $CF_3$ | H | H | 1 |
| A-35 | " | " | $CO_2K$ | Cl | H | 2 |
| A-36 | " | $CH_2CO_2K$ | H | Cl | H | 2 |
| A-37 | " | $CH_2SO_3H$ | $(CH_2)_4SO_3H$ | H | H | 3 |

(III)

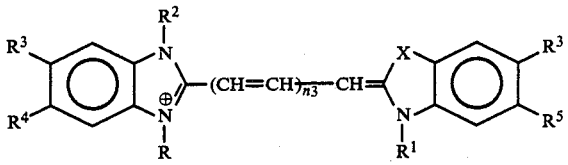

| | X | R | R¹ | R² | R³ | R⁴ | R⁴ | $n_3$ |
|---|---|---|---|---|---|---|---|---|
| A-38 | S | $(CH_2)4SO_3^{\ominus}$ | $(CH_2)_4SO_3Na$ | $CH_2CO_2K$ | H | $CF_3$ | $CO_2K$ | 1 |
| A-39 | S | " | " | $(CH_2)_4SO_3K$ | $CO_2K$ | H | $CO_2K$ | 1 |
| A-40 | S | " | " | " | H | $(CH_2)_4SO_3K$ | $O(CH_2)_2SO_3K$ | 1 |
| A-41 | S | " | $C_2H_5$ | " | H | $CH_2CO_2K$ | $CH_2CO_2K$ | 1 |
| A-42 | S | $(CH_2)_3SO_3^{\ominus}$ | $(CH_2)_3SO_3Na$ | $(CH_2CO_2Na$ | H | $CF_3$ | $SO_3Na$ | 2 |

-continued

| | | | | | | | | |
|---|---|---|---|---|---|---|---|---|
| A-43 | S | " | " | " | H | Cl | " | 0 |
| A-44 | O | " | " | $CH_2CO_2Na$ | H | Cl | $CO_2Na$ | 1 |
| A-45 | O | $(CH_2)_2SO_3^{\ominus}$ | $(CH_2)_2SO_3Na$ | $CH_2SO_3Na$ | H | Cl | " | 2 |
| A-46 | O | " | " | " | H | Cl | " | 3 |

(IV)

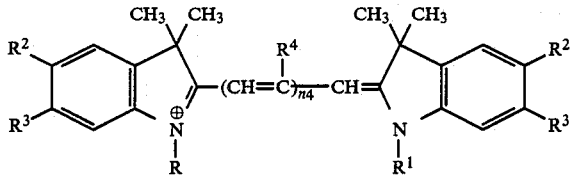

| | R | $R^1$ | $R^2$ | $R^3$ | $R^4$ | $n_4$ |
|---|---|---|---|---|---|---|
| A-47 | $(CH_2)_3SO_3^{\ominus}$ | $(CH_2)_4SO_3K$ | $SO_3K$ | H | H | 1 |
| A-48 | " | $(CH_2)_4SO_3H$ | $SO_3H$ | H | H | 1 |
| A-49 | " | " | $CH_2CO_2K$ | Cl | H | 1 |
| A-50 | $(CH_2)_2O(CH_2)_3SO_3^{\ominus}$ | $(CH_2)_2O(CH_2)SO_3K$ | $SO_3K$ | H | H | 1 |
| A-51 | $(CH_2)_3SO_3^{\ominus}$ | $(CH_2)_3SO_3Na$ | $(CH_2)_2CO_2Na$ | H | H | 1 |
| A-52 | " | " | $SO_3Na$ | H | Cl | 1 |
| A-53 | $(CH_2)_3SO_3^{\ominus}$ | $(CH_2)_3SO_3Na$ | $CH_2CO_2Na$ | H | — | 0 |
| A-54 | $(CH_2)_2CO_2^{\ominus}$ | $(CH_2)_2CO_2Na$ | $SO_3Na$ | H | — | 0 |
| A-55 | $C_2H_5$ | $C_2H_5$ | $SO_3Na$ | $SO_2Na$ | H | 2 |
| A-56 | $(CH_2)_3SO_3^{\ominus}$ | $(CH_2)_3SO_3Na$ | $CO_2Na$ | H | H | 2 |

(V)

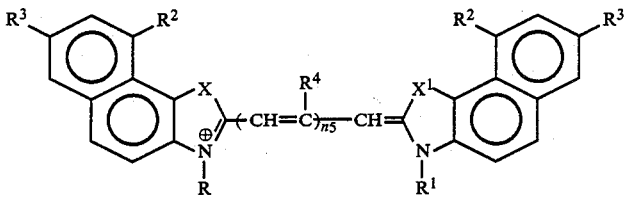

| | X | $X^1$ | R | $R^1$ | $R^2$ | $R^3$ | $R^4$ | $n_5$ |
|---|---|---|---|---|---|---|---|---|
| A-57 | O | O | $(CH_2)_3SO_3^{\ominus}$ | $(CH_2)_3SO_3Na$ | $SO_3Na$ | $SO_3Na$ | — | 0 |
| A-58 | O | O | " | " | " | " | $CH_3$ | 1 |
| A-59 | O | O | " | " | $CO_2Na$ | $CO_2Na$ | H | 2 |
| A-60 | S | S | $C_2H_5$ | $C_2H_5$ | $SO_3Na$ | $SO_3Na$ | H | 1 |
| A-61 | S | S | $CH_2CO_2^{\ominus}$ | $CH_2CO_2K$ | " | " | — | 0 |
| A-62 | O | S | $(CH_2)_4SO_3^{\ominus}$ | $(CH_2)_4SO_3K$ | " | " | H | 1 |
| A-63 | O | S | " | " | " | " | H | 2 |
| A-64 | $NCH_3$ | $NCH_3$ | " | " | " | " | H | 1 |
| A-65 | $NCH_3$ | S | " | " | " | " | H | 1 |
| A-66 | $NCH_3$ | O | " | " | " | " | H | 1 |

(VI)

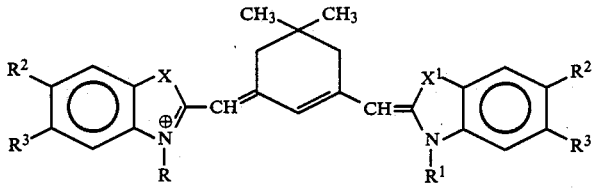

| | X | $X^1$ | R | $R^1$ | $R^2$ | $R^3$ |
|---|---|---|---|---|---|---|
| A-67 | S | S | $(CH_2)_3SO_3^{\ominus}$ | $(CH_2)_3SO_3Na$ | $SO_3Na$ | H |
| A-68 | S | S | " | $(CH_2)_3SO_3K$ | $CO_2K$ | H |
| A-69 | S | O | " | " | H | $SO_3K$ |
| A-70 | S | O | " | " | $OCH_2SO_3K$ | H |

A-71

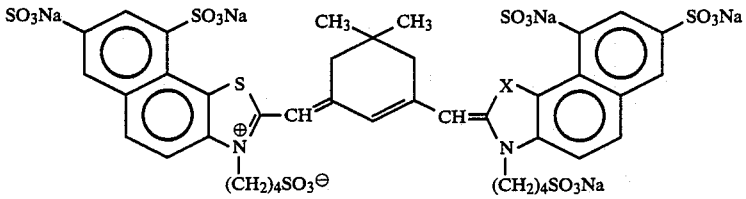

X = S, O

-continued
A-72
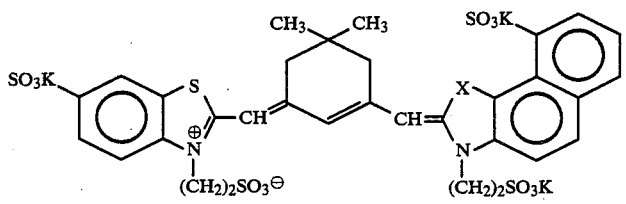
X = S, O
A-73
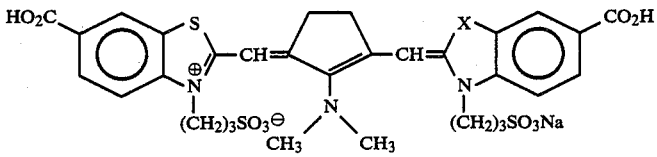
X = S, O
A-74
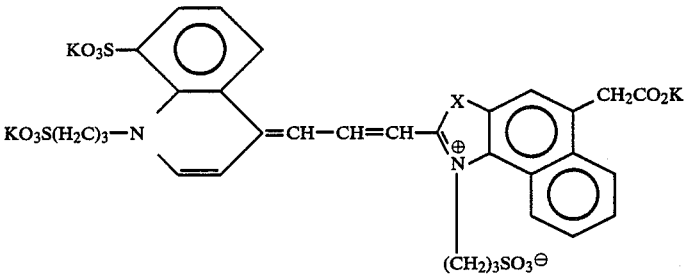
X = S, O
A-75
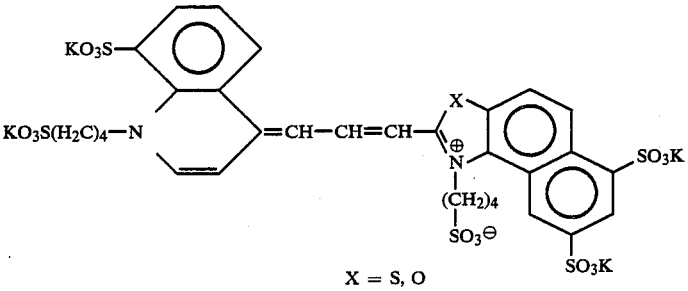
X = S, O
A-76
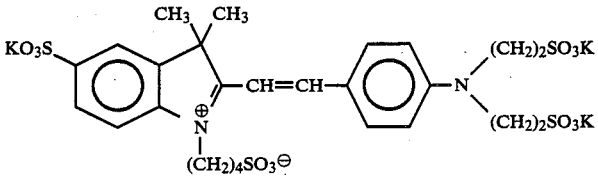
A-77
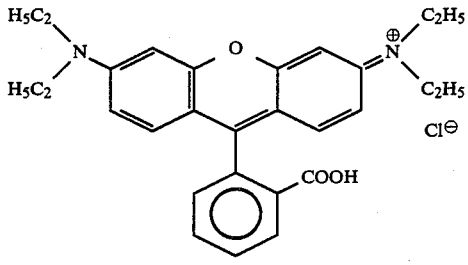

-continued

A-78

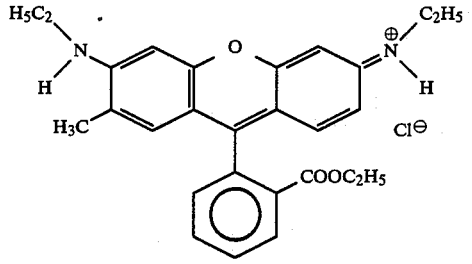

A-79

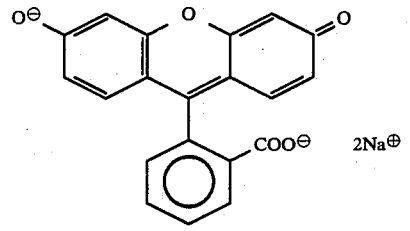

All of the above-illustrated light-collecting dyes (A-1 to A-79) have an emission quantum yield of at least 0.1 at a concentration of $10^{-4}$ mol/dm$^3$ in dry gelatin at room temperature. In particular, Dyes A-1 to A-11 and Dyes A-47 to A-54 have high emission quantum yields of 0.7 or more.

Of the above-described dyes light-collecting to be used in the present invention, the cyanine dyes can be synthesized by known processes, for example, the various processes described in F. M. Hamer, *The Cyanine Dyes and Related Compounds,* Interscience, New York (1964); G. E. Ficken, *The Chemistry of Synthetic Dyes,* K. Venkataraman, ed., Academic Press, New York and London, 1971, Vol. 4, Chapter V; D. J. Fry, *Rodd's Chemistry of Carbon Compounds,* 2nd Edition, Elsevier Science Publishing Company Inc., New York, 1977, Vol. 4 part B Chapter 15; and D. J. Fry, *Rodd's Chemistry of Carbon Compounds,* supplements to the 2nd Ed. Elservier Science Pub. Comp. Inc., New York, 1985, Vol. 4 part B Chapter 15. Typical synthesis examples are set forth below.

Synthesis of Dye A-1

In a 100 ml-volume flask equipped with a stirrer were placed 6.5 g of 4-(6-carboxy-2-methylbenzoxazolio-3)butanesulfonate, 12 g of ethyl orthoformate, 18 ml of pyridine, and 7 ml of acetic acid, and the mixture was heated while stirring for 1.5 hours in an oil bath previously heated to 140° C. After allowing the mixture to cool, the precipitated crystals were collected by filtration, washed successively with acetone and methanol, and dissolved in methanol containing triethylamine. Any insoluble matter was removed by filtration, and a methanolic solution of sodium iodide was added to the filtrate. The precipitated crystals were separated by filtration, washed with methanol while hot, and dried under reduced pressure to obtain 4.11 g (58.5% yield) of Dye A-1 having a melting point of 300° C. or higher.

$$\lambda_{max}^{MeOH} = 496 \text{ nm } (\epsilon = 1.32 \times 10^5)$$

Synthesis of Dye A-47

In a 1 l-volume flask equipped with a stirrer were charged 69 g of 4-(3,3,3-trimethyl-5-sulfo-3H-indolio-3-)-butanesulfonate, 55 ml of ethyl orthoformate, 69 ml of acetic acid, and 150 ml of pyridine, and the mixture was heated with stirring for 1 hour in an oil bath previously heated to 140° C. After allowing the mixture to cool to room temperature, 400 ml of acetone was added thereto, followed by decantation to remove the supernatant liquor. The residual solid was dissolved in 500 ml of methanol, and a methanolic solution of potassium acetate was added thereto, followed by heat-refluxing for 10 minutes. The precipitated crystals were collected by filtration and washed with isopropanol. The solid was reprecipitated using water and isopropanol, and the resulting crystals were dried under reduced pressure to obtain 41.2 g (52.3%) of Dye A-47 having a melting point of 300° C. or higher.

$$\lambda_{max}^{MeOH} = 555 \text{ nm } (\epsilon = 1.33 \times 10^5)$$

In the silver halide photographic materials of the present invention incorporating a light-collecting dye, the light-sensitive silver halide forms a fine dispersion in a suitable medium, and the individual silver halide grains have an adsorbed layer of a spectral sensitizing dye on their surface and are spectrally sensitized thereby. External to this adsorbed layer of the sensitizing dye is a hydrophilic colloidal medium having uniformly dispersed therein a water-soluble light-collecting dye and at least a specified amount of an anionic surface active material, this medium thus forming a light-sensitive element in cooperation with the light-sensitive silver halide.

The light-collecting dye and anionic surface active material are preferably incorporated in a silver halide emulsion layer containing an adsorbable sensitizing dye.

The light-collecting dye is preferably added to a dispersion medium in a concentration of at least $2\times10^{-3}$ mol/dm$^3$, and more preferably at least $10^{-2}$ mol/dm$^3$. The term "concentration" as used herein means a concentration based on a dry volume of a dispersion medium excluding the silver halide grain surface and the sensitizing dye adsorbed on the grain surface. The upper limit of the concentration is preferably $10^{-1}$ mol/dm$^3$ considering that too a high concentration sometimes causes saturation or reduction of sensitization efficiency.

The light-collecting dyes may be used either individually or in combinations of two or more provided that at least a part of the emission wavelength band of these dyes overlaps with the optical absorption band of at least one sensitizing dye adsorbed onto the silver halide grains. For substantial satisfaction of this condition, it is desirable that the light-collecting dye which gives its maximal emission at a longer wavelength than any other light-collecting dyes exhibits its highest emission wavelength in the vicinity of the maximum absorption wavelength of the sensitizing dye which gives its maximal absorption at a longer wavelength than any other sensitizing dyes to which the energy is transmitted, and more preferably within a range of from the maximum absorption wavelength to a wavelength shorter by 60 nm, and particularly by 30 nm. Further, to favor Förster type energy transfer, it is preferable for the light-collecting dye itself to provide a substantial overlap between an absorption band and an emission band in the medium, with the difference between the maximum absorption wavelength and the maximum emission wavelength, i.e., the Stokes' shift, being within 40 nm, and more preferably within 20 nm, in the medium.

The light-collecting dye present in a hydrophilic colloidal layer according to the present invention may be mordanted with an appropriate cationic polymer, etc. Examples of the cationic polymers suitable for this purpose are described, e.g., in British Pat. No. 685,475, U.S. Pat. Nos. 2,675,316, 2,839,401, 2,882,156, 3,048,487, 3,184,309 and 3,445,231, West German OLS No. 1,914,362, JP-A Nos. 50-47624 and 50-71332.

The light-collecting dye to be used in the invention should be rapidly driven out of the light- sensitive material by development processing or washing with water or should be decomposed and bleached during processing. It is preferable to use a light-collecting dye of a type that can be decolorized by, for example, hydrolysis in an alkaline processing solution after having been removed from the light-sensitive material.

The light-collecting dye for use in the present invention preferably has a reduction potential more anodic than −1.0 V with reference to a saturated calomel electrode in a water/ethanol (1:1 by volume) solution. The reduction potential of dyes can be measured in accordance with the method described in Tadaaki Tani et al., *Denkikaqaku,* Vol. 34, p. 149 (1966).

The hydrophilic dispersion medium which can be used in the emulsion layers or intermediate layers in the light-sensitive material of the present invention is advantageously gelatin. Other hydrophilic colloids may also be used, including proteins, such as gelatin derivatives, graft polymers of gelatin and other high polymers, albumin, casein, etc.; cellulose derivatives, e.g., hydroxyethyl cellulose, carboxymethyl cellulose, cellulose sulfate, etc.; sugar derivatives, e.g., sodium alginate, starch derivatives, etc.; and a variety of synthetic hydrophilic high polymers, e.g., polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc., and copolymers comprising monomers constituting these homopolymers. The gelatin to be used includes not only lime-processed gelatin for general purposes, but also acid-processed gelatin, enzyme-processed gelatin as described in *Bull. Soc. Sci. Photo. Japan,* No. 16, p. 30 (1966), and hydrolysis products of gelatin.

The halogen composition of light-sensitive silver halide for use in the present invention is conventional and includes, for example, silver bromide, silver iodobromide, silver chloride, silver chlorobromide, silver chloroiodobromide, etc. The light-sensitive silver halide grains may have any crystal form, such as spherical, tabular, octahedral, cubic, tetradecahedral, and amorphous forms. Inter alia, tabular grains are preferred because of their large area for dye adsorption in favor of high spectral sensitization. The tabular grains preferably comprise those having an aspect ratio (diameter/thickness ratio) of at least 5, and particularly at least 8, in a ratio of 50% or more based on the total projected area. Examples of preferred tabular grains are described, for example, in *Research Disclosure,* No. 22534, Vol. 225 (January, 1983), JP-A-No. 58-127921, JP-A-No. 59-99433 and U.S. Pat. No. 4,585,729.

The individual silver halide grains may be either homogeneous or heterogeneous in halogen composition. Heterogeneous grains preferably include those having a double-layered structure in which the core and the outer shell have different compositions as described in, for example, JP-A-No. 58-113926, JP-A-No. 113927 and JP-A-No. 59-99433. In addition, epitaxially grown grains in which fine crystals having different halogen compositions are fused together as described in U.S. Pat. Nos. 4,094,684, 4,459,343, and 4,463,087, and JP-A-No. 58-108526; grains having incorporated therein a spectral sensitizing dye as described in *Photo. Sci. Eng.,* Vol. 8, p. 102 (1968); grains having a high-order index of a plane as described in JP-A-No. 62-123446; grains of troglodyte nuclei type as described in JP-B-No. 58-1409 (the term "JP-B" as used herein means an "examined Japanese patent publication); grains having sensitivity nuclei in the near-surface interior as described in Japanese Patent Application No. 306029/86; and the like can also be preferably employed.

The mean grain size of the silver halide grains is not particularly limited and is preferably not greater than 3 μm, and more preferably not greater than 1.8 μm, as a diameter of a corresponding sphere. Grain size distribution may be either narrow or broad.

The individual silver halide grains may have a homogeneous phase or a heterogeneous phase between the interior and the surface. They may be of a surface latent image type which forms a latent image predominantly on their surface or of an internal latent image type which forms a latent image predominantly in the interior thereof.

In the process of silver halide grain formation or physical ripening, a cadmium salt, a zinc salt, a lead salt, a thallium salt, an iridium salt or a complex salt thereof, a rhodium salt or a complex salt thereof, an iron salt or a complex salt thereof, etc. may be present in the system.

Silver halide emulsions to be used may be so-called primitive (i.e., chemically unsensitized) but are usually subjected to chemical sensitization in a well-known manner. Chemical sensitization techniques are described, e.g., in H. Frieser (ed.), *Die Grundlaqen der Photographischen Prozesse mit Silber-halogeniden,* pp. 675–734, Akademische Verlagsgesellschaft (1968).

Briefly, however, chemical sensitization can be carried out by sulfur sensitization using active gelatin or a sulfur-containing compound capable of reacting with silver (e.g., thiosulfates, thioureas, mercapto compounds, rhodanines, etc.), reduction sensitization using a reducing substance (e.g., stannous salts, amines, hydrazine derivatives, formamidine-sulfinic acid, silane compounds, etc.), noble metal sensitization using a noble metal compound (e.g., gold complex salts and complex salts of other noble metals of Group VIII such as Pt, Ir and Pd), or a combination thereof. In the present invention, sulfur sensitization or a combination of sulfur sensitization and gold sensitization is particularly preferred.

For the purpose of preventing fog during preparation, preservation or photographic processing of light-sensitive materials or stabilizing photographic performance, a variety of compounds may be incorporated into silver halide photographic emulsions. Such compounds include azoles, e.g., benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5-mercaptotetrazole), etc.; mercaptopyrimidines; mercaptotriazines; thioketo compounds, e.g., oxazolinethion, etc.; azaindenes, e.g., triazaindenes, tetraazaindenes (especially 4-hydroxy-substituted (1,3,3a,7)tetraazaindenes), pentaazaindenes, etc.; benzenethiosulfonic acids, benzenesulfinic acids, benzenesulfonic acid amines; and other various compounds known as antifoggants or stabilizers.

For the purpose of increasing sensitivity or contrast or accelerating development, the photographic emulsions may further contain, for example, polyalkylene oxide or derivatives thereof, e.g., ethers, esters and amines, thioether compounds, thiomorpholine compounds, quaternary ammonium salt compounds, urethane derivatives, urea derivatives, imidazole derivatives, 3-pyrazolidone compounds, and the like.

At least one kind of the light-sensitive silver halide used in the present invention is subjected to spectral sensitization with an adsorbable spectral sensitizing dye. In this case, it is desirable that the surface coverage of the adsorbable dye is at least 20%, and more preferably at least 40%, of a saturated adsorption in a monomolecular layer. Light-sensitive materials using a sensitizing dye for spectral sensitization include negative light-sensitive materials of the general surface latent image type and direct positive light-sensitive materials of the internal latent image type.

Suitable positive light-sensitive materials include, for example, those in which an electron accepting dye is used and a positive image is formed by destruction of surface fog centers upon exposure to light.

Depending on the use of the light-sensitive material, the adsorbable dye may be used in combination with adsorbable supersensitizers or various additives (e.g., antifoggants) for the purpose of attaining the optimum degree of spectral sensitization.

The adsorbable dye for spectral sensitization includes cyanine dyes, merocyanine dyes, complex cyanine dyes, complex merocyanine dyes, holopolar cyanine dyes, hemicyanine dyes, styryl dyes, hemioxonol dyes, xanthene dyes, triarylmethane dyes, phenothiadine dyes, acridine dyes, metal chelate compounds, and the like. Of these, cyanine dyes, merocyanine dyes, and complex merocyanine dyes are particularly useful.

To these dyes can contain any of basic heterocyclic nuclei usually utilized in cyanine dyes, such as pyrroline, oxazoline, thiazoline, pyrrole, oxazole, thiazole, selenazole, imidazole, tetrazole, and pyridine nuclei; the above-enumerated nuclei to which an alicyclic hydrocarbon ring is fused; and the above-recited nuclei to which an aromatic hydrocarbon ring is fused, e.g., indolenine, benzindolenine, indole, benzoxazole, naphthoxazole, benzothiazole, naphthothiazole, benzoselenazole, benzimidazole, and quinoline nuclei. These nuclei may be substituted on the carbon atom.

Preferred among these cyanine dyes are those which exhibit especially high sensitizing efficiency when used alone or in combination with a supersensitizer. Such cyanine dyes include those having at least one of thiazole, selenazole, quinoline, and indolenine nuclei and those having either at least two oxazole nuclei or at least two imidazole nuclei. Of course, these basic heterocyclic nuclei in the preferred cyanine dyes may have an alicyclic hydrocarbon ring and/or an aromatic hydrocarbon ring fused thereto.

To merocyanine dyes or complex merocyanine dyes is applicable a 5- or 6-membered heterocyclic nucleus having a ketomethylene structure, such as pyrazolin-5-one, thiohydantoin, 2-thiooxazolidine-2,4-dione, thiazolidine-2,4-dione, rhodanine, and thiobarbituric acid nuclei, etc. Specific examples of useful sensitizing dyes are described, e.g., in German Pat. No. 929,080, U.S. Pat. Nos. 2,231,658, 2,493,748, 2,503,776, 2,519,001, 2,912,329, 3,656,959, 3,672,897, 3,694,217, 4,025,349 and 4,046,572, British Pat. No. 1,242,588, and JP-B-No. 44-14030, and JP-B-No. 52-24844.

These sensitizing dyes may be used either individually or in combination. In particular, combinations of sensitizing dyes are frequently employed for the purpose of supersensitization. Typical examples of such dye combinations are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, JP-B-No. 43-4936, JP- B-No. 53-12375, JP-A-No. 52-110618, and JP-A-No. 52-109925.

The photographic emulsions may contain, in addition to the sensitizing dye, a dye having no spectral sensitizing activity by itself or a substance that does not absorb a substantial amount of visible light, while exhibiting supersensitizing activity. Examples of such a dye or substance include aminostilbene compounds substituted with a nitrogen-containing heterocyclic group (e.g., the compounds described in U.S. Pat. No. 2,933,390 and 3,635,721), aromatic organic acid-formaldehyde condensates (e.g., the compound described in U.S. Pat. 3,743,510), cadmium salts, and azaindene compounds. The combinations described in U.S. Pat. Nos. 3,615,613, 3,615,641, 3,617,295 and 3,635,721 are particularly useful.

In the case where the present invention is applied to color light-sensitive materials, various color couplers capable of forming a dye upon coupling with the oxidation product of an aromatic primary amine developing agent can be employed. Typical examples of useful color couplers are cyan couplers, e.g., naphthol compounds and phenol compounds; magenta couplers, e.g., pyrazolone compounds and pyrazoloazole compounds; and yellow couplers, e.g., open-chain or heterocyclic ketomethylene compounds. Specific examples of these cyan, magenta, and yellow couplers are described in the patents cited in *Research Disclosure,* 17643, VII-D (December, 1978) and ibid, 18717 (November, 1979).

In order to satisfy the characteristics required for the present light-sensitive material, two or more kinds of these couplers may be incorporated into one layer, or one kind of these couplers may be incorporated into two or more layers.

Color negative light-sensitive materials for photography preferably contain colored couplers for correction of unnecessary absorption in the shorter wavelength region exhibited by the dye produced from magenta or cyan couplers. Typical examples of the colored couplers include yellow-colored magenta couplers as described, e.g., in U.S. Patent 4,163,670 and JP-B-No. 57-39413 and magenta-colored cyan couplers as described, e.g., in U.S. Pat. Nos. 4,004,929 and 4,138,258, and British Pat. No. 1,146,368.

Couplers which produce a dye having moderate diffusibility can be used to improve graininess. Specific examples of such "blurring" couplers are described in U.S. Pat. No. 4,366,237 and British Pat. No. 2,125,570 for magenta couplers; and European Pat. No. 96,570 and West German OLS No. 3,234,533 for yellow, magenta or cyan couplers.

The dye forming couplers and the above-described special couplers may be in the form of a polymer, including a dimer. Typical examples of polymerized dye forming couplers are described in U.S. Pat. Nos. 3,451,820 and 4,080,211. Specific examples of polymerized magenta couplers are described in British Pat. No. 2,102,173, U.S. Pat. No. 4,367,282, JP-A-No. 61-232455, and Japanese Patent Application No. 60-113596.

Couplers capable of releasing a photographically useful residue upon coupling are also preferably used in the present invention. Useful DIR couplers capable of releasing a developing inhibitor are described in the patents cited in *Research Disclosure,* 17643, VII-F (December, 1978).

In addition, the light-sensitive material of the present invention may contain couplers capable of releasing imagewise a nucleating agent or a development accelerator or a precursor thereof. Specific examples of such couplers are described in British Pat. Nos. 2,097,140 and 2,131,188. In particular, couplers releasing a nucleating agent, etc. which is adsorbable onto silver halide grains, such as those described in JP-A-No. 59-157636 and JP-A-No. 59-170840 are preferred.

Any hydrophilic colloidal layer comprising the photographic emulsion layers or backing layer in the light-sensitive material of the present invention may contain an organic or inorganic hardening agent. Suitable hardening agents include chromium salts, aldehydes (e.g., formaldehyde, glyoxal, glutaraldehyde, etc.), N-methylol compounds (e.g., dimethylolurea, etc.), and the like. Active halogen compounds (e.g., 2,4-dichloro-6-hydroxy-1,3,5-triazine, etc.) and active vinyl compounds (e.g., 1,3-bisvinylsulfonyl-2- propano1,1,2-bisvinylsulfonylacetamidoethane, vinyl polymers having a vinylsulfonyl group in the side chain thereof, etc.) are preferred hardening agents as they rapidly harden a hydrophilic colloid, such as gelatin, to provide stable photographic characteristics. N-carbamoylpyridinium salts and haloamidinium salts are also excellent in rate of hardening.

In addition, the silver halide emulsion to be used in this invention may contain various other additives, such as surface active agents, thickeners, dyes, ultraviolet absorbers, antisalts, brightening agents, desensitizers, developing agents, discoloration inhibitors, mordants, and the like. Specific examples of these additives are described, e.g., in *Research Disclosure,* 17643, Vol. 176, pp. 22–31 (December, 1978) and T. H. James (ed.), *The Theory of the Photographic Process* (4th Ed.), Macmillan Publishing Co., Inc. (1977).

The photographic emulsion layers and other layers in the photographic material of the present invention are coated on a support chosen from those usually employed for photographic materials including flexible supports, such as plastic films, paper, cloth, etc.; and rigid supports, such as glass, ceramics, metals, etc. Useful flexible supports include films made of synthetic or semi-synthetic high polymers, e.g., cellulose nitrate, cellulose acetate, cellulose acetate butyrate, polystyrene, polyvinyl chloride, polyethylene terephthalate, polycarbonate, etc.; and paper coated or laminated with a baryta layer or an $\alpha$-olefin polymer (e.g., polyethylene, polypropylene, an ethylene/butene copolymer, etc.).

These supports may be colored with dyes or pigments, if desired. They may be colored in black for the purpose of light shielding.

The surface of the support is generally subjected to subbing treatment to improve adhesion to the photographic emulsion layers, etc. Before or after the subbing treatment, the surface of the support may be subjected to glow discharge treatment, corona discharge treatment, ultraviolet irradiation, flame treatment or other surface treatments.

Exposure to light for forming a photographic image can be carried out in a conventional manner using any known light source, such as natural light (sunlight), a tungsten lamp, a fluorescent lamp, a mercury lamp, a xenon arc lamp, a carbon arc lamp, a xenon flash lamp, a cathode ray tube (CRT), a flying spot, etc. The exposure time usually ranges from 1/1000 second (generally used in photography with cameras) to 1 second. Exposure may also be effected for a time shorter than 1/1000 second, e.g., from $1/10^4$ to $1/10^9$ second, with a xenon flash lamp, a CRT, or a laser beam; or for a time longer than 1 second, depending on the application. If desired, a color filter can be used to control the spectral composition of the exposing light. Further, exposure may be carried out using light emitted from a fluorescent substance excited by electron rays, X-rays, $\gamma$-rays, $\alpha$-rays, etc.

Photographic processing of the light-sensitive materials according to the present invention can be carried out by any of the known methods using known processing solutions whether for black-and-white photographic processing for forming a silver image or for color photographic processing for forming a dye image, for example, by the methods and processing solutions described in *Research Disclosure,* 17643, Vol. 176, pp. 28–30 (December, 1978). The processing temperature is usually selected within the range between 18° C. and 50° C. Temperatures lower than 18° C. or higher than 50° C. are also employable.

In a special mode of development processing that is applicable to the light-sensitive materials of the present invention, a developing agent may be incorporated into the light-sensitive material (into, e.g., an emulsion layer), and the light-sensitive material is processed in an alkaline aqueous solution to carry out development. In this case, a hydrophobic developing agent can be introduced into an emulsion layer according to various methods as described, e.g., in *Research Disclosure,* 16928, Vol. 169 (May, 1978), U.S. Pat. No. 2,739,890, British Pat. No. 813,253, and West German Pat. No. 1,547,763. Such development processing may be combined with silver salt stabilization processing using thiocyanates.

The fixing solution to be used may have a commonly employed composition. Useful fixing agents include not only thiosulfates and thiocyanates, but also organic sulfur compounds known to exhibit fixing effects. The fixing solution may contain a water-soluble aluminum salt as a hardening agent.

A color developer generally comprises an alkaline aqueous solution containing a color developing agent. The color developing agent includes known aromatic primary amine developing agents, such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, etc.).

In addition, the color developing agents disclosed in L. F. A. Mason, *Photographic Processing Chemistry,* 226–229, (Focal Press, 1966), U.S. Pat. Nos. 2,193,015 and 2,592,364, and JP-A-No. 48-64933 are also useful.

The color developer may contain one or more pH buffering agents, development restrainers, antifoggants, etc. If desired, it may further contain one or more water softeners, preservatives, organic solvents, development accelerators, dye forming couplers, competing couplers, fogging agents, auxiliary developing agents, viscosity-imparting agents, polycarboxylic acid type chelating agents, antioxidants, and the like. Specific examples of these additives are described, e.g., in *Research Disclosure,* 17643 (December, 1978), U.S. Pat. No. 4,083,723, and West German OLS No. 2,622,950.

The photographic emulsion layers after color development are generally subjected to bleaching. Bleaching may be effected simultaneously with fixation, or these two steps may be performed separately. Suitable bleaching agents include compounds of polyvalent metals (e.g., iron (III), cobalt (III), chromium (VI), copper (II), etc.), peracids, quinones, nitroso compounds, and so on. Examples of these bleaching agents are ferricyanides; bichromates; organic complex salts of iron (III) or cobalt (III), such as complex salts with an aminopolycarboxylic acid (e.g., ethylenediaminetetraacetic acid, nitrilotriacetic acid, 1,3-diamino-2-propanoltetracetic acid, etc.) or an organic acid (e.g., citric acid, tartaric acid, malic acid, etc.); persulfates; permangantates; nitrosophenol; and the like. Of these, potassiumferricyanide, sodium (ethylenediaminetetraacetato)iron (III), and ammonium (ethylenediaminetetraacetato)iron(III) are particularly useful. Ethylenediaminetetraacetato iron (III) salts are useful in both an independent bleaching bath and a combined blix bath.

The bleach or blix bath can contain various additives, such as a bleach accelerator as described in U.S. Pat. No. 3,042,520 and 3,241,966, JP-B-No. 45-8506, and JP-B-No. 45-8836; a thiol compound as described in JP-A-No. 53-65732; and the like.

In carrying out photographic processing of the light-sensitive materials according to the present invention, an additive capable of reacting with the light-collecting dye present in the light-sensitive material to thereby decompose the light-collecting dye may be incorporated into any processing solution such as developer, blix bath, etc.

The present invention can be applied to a variety of light-sensitive materials for both color and black-and-white photography, typically embracing color negative films for general use or for movies, color reversal films for slides or TV, color papers, color positive films, color reversal films, color light-sensitive materials for a diffusion transfer process, and heat developable color light-sensitive materials. The present invention is also applicable to black-and-white photographic materials including X-ray films by utilizing mixing of three color couplers as disclosed in *Research Disclosure,* 17123, Vol. 171 (July, 1978) or black-forming couplers as disclosed in U.S. Pat. No. 4,126,461 and British Pat. No. 2,102,136. The present invention is also applicable to platemaking films, such as lith films and scanner films, direct or indirect X-ray films for medical or industrial use, black-and-white negative films for photography, black-and-white photographic materials for a silver salt diffusion transfer process, and print-out type photographic materials.

In the application of the present invention to a silver halide light-sensitive material containing an emulsion layer which has been spectrally sensitized with a sensitizing dye, one advantage of the present invention is the improvement of the spectral sensitivity of the emulsion due to the combined use of a light-collecting dye with the sensitizing dye. In a particularly preferred application of the present invention, the relatively low sensitivity to a wavelength region corresponding to a valley between an inherent sensitivity and a spectral sensitivity, e.g., sensitivity to a blue region (from 450 to 520 nm), is improved by the addition of a light-collecting dye in the case of black-and-white light-sensitive materials, or the spectral sensitivity to a blue, green, or red region is further enhanced by the addition of a light-collecting dye to color light-sensitive materials.

Since the light-collecting dye in a dispersion medium serves as a sensitizer and, at the same time, as an absorber by itself, the technique according to the present invention is effective not only to improve sensitivity through spectral sensitization, but also to improve image sharpness by taking advantage of the anti-irradiation effect or anti-halation effect of the light-collecting dye. In general, use of anti-irradiation dyes or anti-halation dyes is attended by desensitization due to optical filter effects. Quite surprisingly, however, the present invention makes it possible to improve sharpness while increasing sensitivity without causing a substantial reduction of sensitivity.

Taking, for instance, direct X-ray films for medical use having an emulsion layer on both sides of a support, it is known that fluorescence emitted from a fluorescent intensifying screen and transmitted to a light-sensitive layer on the side opposite to the incident side, i.e., so-called cross-over light, will seriously impair image sharpness. By applying the present invention to this photographic medium, the light absorption on the incident side is greatly increased so that sensitivity is increased and, at the same time, the above-described cross-over light is blocked to thereby bring about marked improvement in sharpness.

Preferred embodiments of the claimed invention are further illustrated as set forth below:

1. The absorbable spectral sensitizing dye is selected from merocyanine dyes, cyanine dyes having at least one of thiazole, selenazole, quinoline, and indolenine nuclei, and cyanine dyes having at least two oxazole nuclei or at least two imidazole nuclei, the basic heterocyclic nuclei in the cyanine dyes optionally having an alicyclic hydrocarbon ring and/or an aromatic hydrocarbon ring fused thereto.

2. The luminescent dye has a concentration of not more than $10^{-1}$ mol/dm$^3$ in the hydrophilic dispersion medium.

3. The luminescent dye is a water-soluble cyanine dye containing at least three sulfo and/or carboxyl groups.

4. The luminescent dye has an emission quantum yield of at least 0.5.

5. The luminescent dye has a maximum emission wavelength which does not exceed the maximum absorption wavelength of spectral sensitizing dye whose absorption wavelength is at the longest of those of the spectral sensitizing dyes absorbed on the silver halide grains.

6. The luminescent dye has a reduction potential more anodic than −1.0 V with reference to a saturated calomel electrode (S.C.E.) in a water/ethanol (1:1 by volume) solution.

7. The anionic surface active material is present in an amount of at least $3.0\times10^{-4}$ gram equivalents as anion per gram of the hydrophilic dispersion medium.

8. The anionic surface active material is water-soluble and dissolves in an amount of at least 5% in an aqueous medium at room temperature.

The present invention is illustrated in greater detail by way of the following examples, but it should be understood that the present invention is not deemed to be limited to these examples. Unless otherwise indicated, all parts, percents, ratios and the like and by weight.

EXAMPLE 1

A solution (1 l) containing 200 g of silver nitrate and a solution containing 150 g of potassium bromide in 1 l were added simultaneously to a solution (1 l) containing 15 g of inactivated gelatin at 35° C. over a period of 20 minutes under thorough stirring with the pBr being held at 2.20. In this case, the solution of silver nitrate was added at a constant rate. As a result, cubic silver bromide emulsion grains having an average length of 0.073 μm per side were obtained. After subjecting the emulsion to flocculation washing, gelatin was freshly added and the pH was adjusted to 6.5, followed by chemical sensitization with thiourea and chloroauric acid. The completed emulsion weighing 1,500 g contained 95 g of gelatin and 200 g of silver in terms of silver nitrate (emulsion A).

To 23 g of emulsion A, 23 g of a 10 wt % gelatin solution, 50 mg of 4-hydroxy-6-methyl-1,3,3a,7-tetraazaindene and $2\times10^{-5}$ moles of spectral sensitizing dye S-1 (see below) were added. To this mixture, light-collecting dye A-77 listed above (whose emission quantum yield at a concentration of $10^{-4}$ mol/dm3 in dry gelatin was 0.64) and surfactant M-1 having the structural formula shown below were added in the amounts noted in Table 2. After adding a coating aid, the resulting coating solutions were applied to an acetyl cellulose support and dried.

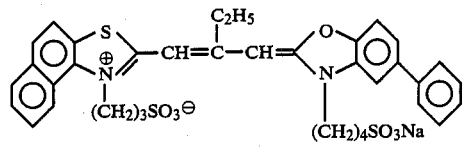

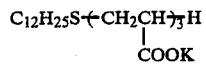

The coating weights of applied silver and gelatin were 1.25 g/m$^2$ and 2.3 g/m$^2$, respectively. Each of the coated samples was exposed to blue-light (420 nm) or monochromatic light at 561 nm or 630 nm from a light source (color temperature, 2854° K.) through a blue-light bandpass filter (BPN-42) or the combination of an interference filter and a continuous wedge. The exposed samples were developed with a surface developer (for its formulation, see below) at 20° C. for 10 minutes, fixed, rinsed and dried. Thereafter, the sensitivity of each sample was evaluated in terms of a relative value with the value for Comparative Sample I-1 being taken as 100. The sensitivity is the reciprocal of the amount of exposure that provides an optical density of fog+0.1.

TABLE 1

| Formulation of Surface Developer | |
|---|---|
| Monomethyl paraaminophenol surfate | 5 g |
| L-Ascorbic acid | 20 g |
| $Na_2BO_3$ | 70 g |
| KBr | 2 g |
| Water | to make 1,000 ml |

The blue sensitivity is the sensitivity due to the intrinsic absorption of silver halide. The wavelength 560 nm is close to the absorption peak (561 nm) of A-77 in the gelatin film and provides an exposure region where the effect of sensitization by light collection is most remarkable. At 630 nm, there is no absorption by A-77 and hence no effect of sensitization by light collection occurs. However 630 nm is in the tail on the longer wavelength side of the region of direct spectral sensitization by dye S-1. Therefore, sensitization at 561 nm is the product of sensitization by light collection and ordinary spectral sensitization, whereas sensitization at 630 nm is the usual direct spectral sensitization by dye S-1. Accordingly, the ratio of sensitization at 561 nm to that at 630 nm provides a measure of sensitization by light collection. The results are as shown in Table 2. In this table, the amounts of A-77 and surfactant M-1 are expressed, respectively, in terms of moles per gram of dry gelatin in the system and gram equivalents of an anion based On carboxyl group in the system; $S_{561}$ and $S_{630}$ are the reciprocals of the amounts of exposure at 561 nm and 630 nm, as expressed in terms of relative values with the value for Comparative Sample I-1 being taken as 100; and $S_{561}/S_{630}$ is the ratio of $S_{561}$ to $S_{630}$.

TABLE 2

| | Amounts of A-77 and M-1 added and comparison of Relative Sensitivities to Monochromatic Light | | | | | |
|---|---|---|---|---|---|---|
| Sample No. | A-77 ($10^{-5}$ mol/g gelatin) | M-1 ($10^{-4}$ gram eq./g gelatin) | Blue sensitivity | $S_{561}$ | $S_{630}$ | $S_{561}/S_{630}$ |
| I-1 (comparison) | 0 | 0 | 100 | 100 | 100 | 100 |
| I-2 (comparison) | " | 1.05 | 102 | 107 | 110 | 97 |

TABLE 2-continued

| Sample No. | Amounts of A-77 and M-1 added and comparison of Relative Sensitivities to Monochromatic Light: A-77 ($10^{-5}$ mol/g gelatin) | M-1 ($10^{-4}$ gram eq./g gelatin) | Blue sensitivity | $S_{561}$ | $S_{630}$ | $S_{561}/S_{630}$ |
|---|---|---|---|---|---|---|
| I-3 (comparison) | " | 2.10 | 105 | 117 | 116 | 101 |
| I-4 (comparison) | " | 4.20 | 112 | 135 | 135 | 100 |
| I-5 (comparison) | " | 8.40 | 123 | 162 | 166 | 98 |
| I-6 (comparison) | 1.05 | 0 | 71 | 79 | 44 | 180 |
| I-7 (the invention) | " | 1.05 | 89 | 115 | 72 | 160 |
| I-8 (the invention) | " | 2.10 | 105 | 158 | 95 | 166 |
| I-9 (the invention) | " | 4.20 | 115 | 200 | 115 | 174 |
| I-10 (the invention) | " | 8.40 | 120 | 240 | 141 | 170 |
| I-11 (comparison) | 2.10 | 0 | 48 | 48 | 20 | 240 |
| I-12 (the invention) | " | 1.05 | 62 | 93 | 37 | 251 |
| I-13 (the invention) | " | 2.10 | 83 | 145 | 60 | 242 |
| I-14 (the invention) | " | 4.20 | 107 | 214 | 93 | 230 |
| I-15 (the invention) | " | 8.40 | 129 | 251 | 112 | 224 |
| I-16 (comparison) | 4.20 | 0 | 45 | 56 | 27 | 207 |
| I-17 (the invention) | " | 1.05 | 56 | 83 | 42 | 198 |
| I-18 (the invention) | " | 2.10 | 72 | 115 | 55 | 210 |
| I-19 (the invention) | " | 4.20 | 90 | 155 | 72 | 215 |
| I-20 (the invention) | " | 8.40 | 107 | 204 | 95 | 215 |

The blue sensitivities and the values of $S_{561}$ and $S_{630}$ of samples I-1, I-6, I-11 and I-16 which did not contain the surfactant had a tendency to decrease as the addition of A-77 increased, but the decrease in $S_{630}$ was marked as compared with the blue sensitivity. It is therefore concluded that A-77, when used in the absence of a surfactant, decreases the intrinsic sensitivity of silver halide while causing a greater decrease in the ordinary spectral sensitivity imparted by the adsorbed spectral sensitizing dye. The decrease in $S_{561}$ is due to this decrease in the sensitivity imparted by the spectral sensitizing dye, but because of the additional effect of sensitization by light collection by A-77, the decrease in $S_{561}$ is smaller than that in $S_{630}$ which is imparted solely by the spectral sensitizing dye S-1. When surfactant M-1 was added, both the intrinsic sensitivity (blue sensitivity) and the spectral sensitivity ($S_{630}$) which had been decreased due to the addition of A-77 showed a tendency to increase, and when the addition of A-77 was no greater than $2.10\times10^{-5}$ moles, both sensitivities became higher than the levels of comparative sample I-1. In this case, the ratio of $S_{561}$ to $S_{630}$ for a given amount of A-77 is substantially constant irrespective of the change in the addition of M-1, but its value continues to increase as the addition of A-77 is increased up to $2.10\times10^{-5}$ moles per gram of gelatin. In other words, surfactant M-1 shows little effect in increasing the efficiency of sensitization by light collection by A-77, but it serves to inhibit the decrease in intrinsic sensitivity and spectral sensitivity that would otherwise occur on account of increased addition of A-77. In addition, as evidenced by samples I-1 to I-5, further sensitization is achieved by the sensitizing effect of M-1 per se, showing that M-1 helps A-77 exhibit its effect of sensitization by light collection to the fullest extent.

EXAMPLE 2

To 23 g of emulsion A prepared in Example 1, 23 g of a 10 wt % gelatin solution, 50 mg of 4-hydroxy-6-methyl-1,3,3a,7-tetraazaindene, $2\times10^{-5}$ moles of spectral sensitizing dye S-1, $8\times10^{5}$ moles of light-collecting dye A-77, and a surfactant (see Table 3) in an amount of $1.6\times10^{-3}$ gram eq. as anion (i.e., $4.2\times10^{-4}$ gram eq. per gram of dry gelatin) were added. After adding a coating aid, the resulting coating solutions were applied to an acetyl cellulose support. The weights of silver and gelatin in the coated films were 1.25 g/m$^2$ and 2.3 g/m$^2$, respectively. The coated samples were given minus blue exposure (using an SC 48 sharp cut filter) or monochromatic light exposure at 561 nm close to the absorption peak (560 nm) of light-collecting dye A-77 in dry gelatin (using an interference filter) through a continuous wedge with a light source (color temperature, 4800° K.). The exposed samples were developed with a surface developer (for its formulation, see Table 1 in Example 1) at 20° C. for 10 minutes, fixed, rinsed and dried. Thereafter, density measurements were conducted on the processed samples. The relative sensitivities of these samples are shown in Table 4. The sensitivity is the reciprocal of the amount of exposure that provides an optical density of fog+0.1 and is expressed in terms of a relative value, with the value for sample II-1 being taken as 100.

TABLE 3

Surface Active Materials

| | |
|---|---|
| $C_{12}H_{25}S(CH_2CH(COOH))_3H$ | M-1 |
| $C_{12}H_{25}S(=O)_2(CH_2CH(COOK))_3H$ | M-2 |
| $C_{12}H_{25}C_6H_4S(CH_2CH(COOK))_6H$ | M-3 |
| $C_{12}H_{25}S(CH_2CH(CN))_6H$ | M-4 |
| $C_{12}H_{25}S(C_6H_4)(CH_2CH(CN))_3(CH_2CH(COOK))_6H$ | M-5 |
| $C_{12}H_{25}S(C_6H_4)(CH_2CH)_3(CH_2CH(COOK))_6H$ | M-6 |
| $C_{12}H_{25}S(C_6H_4)SO_3Na$ | M-7 |
| $NaO_3S-CH(CH_2COOC_8H_{17})COOC_8H_{17}$ | M-8 |
| $C_{12}H_{25}SO_4Na$ | M-9 |
| $C_8F_{17}SO_2N(C_3H_7)CH_2COOK$ | M-10 |

TABLE 4

The effect of Surfactant on Relative Sensitivity*

| Sample No. | Light-collecting dye | Surfactant | Minus Blue sensitivity | Sensitivity to monochromatic light at 561 nm |
|---|---|---|---|---|
| II-1 (comparison) | absent | absent | 100 | 100 |
| II-2 (comparison) | A-77 | absent | 78 | 102 |
| II-3 (the invention) | " | M-1 | 151 | 214 |
| II-4 (the invention) | " | M-2 | 105 | 141 |
| II-5 (the invention) | " | M-3 | 126 | 182 |
| II-6 (the invention) | " | M-4 | 117 | 166 |
| II-7 (the invention) | " | M-5 | 112 | 151 |
| II-8 (the invention) | " | M-6 | 123 | 170 |
| II-9 (the invention) | " | M-7 | 125 | 251 |
| II-10 (the invention) | " | M-8 | 123 | 132 |
| II-11 (the invention) | " | M-9 | 125 | 251 |
| II-12 (the invention) | " | M-10 | 151 | 275 |

*Relative sensitivity: Relative value, with the sensitivity of sample II-1 at the optical density for fog + 0.1 being taken as 100.

Irrespective of the type of surfactant employed, the samples prepared in accordance with the present invention exhibited higher sensitivities than the comparative samples.

EXAMPLE 3

An aqueous solution of 1.88N silver nitrate and an aqueous solution of 1.95N potassium bromide were added simultaneously to a 1-l aqueous solution (30° C.) containing inactivated gelatin (7 g), potassium hydroxide ($1.2\times10^{-3}$ gram eq.) and potassium bromide ($3.78\times10^{-2}$ gram.eq.) with thorough stirring over a period of 1 minute and 6 seconds, with the rate of addition of each solution being 25 cc per minute. To 350 ml of the resulting emulsion were added 650 ml of water, 25 g of gelatin, 4.3 ml of 1N potassium hydroxide and 5.0 ml of 10% potassium bromide, and the mixture was heated up to 75° C., followed by stirring for 40 minutes. Subsequently, an aqueous solution of 2.94N silver nitrate and an aqueous solution of 2.94N potassium bromide were added simultaneously to the mixture over a period of 10 minutes with the pBr of the reaction solution being held at 1.90. The rate of the addition of the silver nitrate solution was kept at 6 cc per minute. Thereafter, the silver nitrate solution was continued to be added for an additional 20 minutes at a rate of 12 cc per minute with the pBr being held at 1.90. Finally, the solution of silver nitrate was added for 20 minutes at a rate of 20 cc per minute. Immediately after the addition of the two solutions, the mixture was quenched to 30° C. and washed by a flocculation method. To the washed emulsion, 222 g of gelatin was added and the pH mixture was adjusted to 6.5, followed by addition of makeup water to produce the intended emulsion in a yield of 2800 g. The silver bromide grains in this emulsion were highly monodispersed tabular grains having an average projected diameter of 1.4 μm, a coefficient of variation of 11.0% in the distribution of projected diameter and an average thickness of 0.20 μm (aspect ratio, 7.0). To 100 g of this emulsion, 1.4 ml of 0.01% sodium thiosulfate, 1.4 ml of 0.1% potassium thiocyanate and 1.4 ml of 0.01% chloroauric acid were added, and the mixture was chemically ripened at 60° C. for 60 minutes (the resulting emulsion was designated emulsion B).

To 30 g of the chemically sensitized emulsion B, 25 g of 10% gelatin solution, $8.0\times10^{-6}$ moles of spectral sensitizing dye S-2, 10-4 moles of light-collecting dye A-47 (whose emission quantum yield at a concentration of $10^{-4}$ mol/dm$^3$ in dry gelatin was 0.74), a varying amount of surfactant M-1, a hardening agent and a coating aid were added, and the resulting coating solutions were applied to a support and dried. The coating weights of silver and gelatin were 1.70 g/m$^2$ and 3.64 g/m$^2$, respectively. The coated samples were exposed and developed as in Example 1. The minus blue sensitivities of the processed samples are shown in Table 5, where the amount of M-1 added is expressed in terms of gram equivalents as anions in M-1 per gram of gelatin.

TABLE 5

| Sample No. | Sensitization of A-47 Containing System by Means of M-1: M-1 Added (10-4 gram eq./g gelatin) | Minus Blue sensitivity |
|---|---|---|
| III-1(comparison) | 0 | 100 |
| III-2 (the invention) | 1.0 | 104 |
| III-3 (the invention) | 2.0 | 108 |
| III-4 (the invention) | 4.0 | 125 |
| III-5 (the invention) | 8.0 | 144 |

The samples prepared in accordance with the present invention had higher minus blue sensitivities than the comparative sample using A-47 in the absence of M-1, and their sensitivity increased as more M-1 was incorporated.

EXAMPLE 4

To 23 g of emulsion A prepared in Example 1, 23 g of a 10 wt % gelatin solution, $10^{-5}$ moles of spectral sensitizing dye S-2 having the structural formula shown below, and a varying amount of surfactant M-10 were added. To the mixture, $8.0\times10^{-4}$ moles of light-collecting dye A-79 (whose emission quantum yield at a concentration of $10^{-4}$ mol/dm$^3$ in dry gelatin was at least 0.7) was added, followed by addition of a hardening agent and a coating aid. The resulting coating solutions were applied to a support and dried. The coating weights of silver and gelatin were 1.25 g/m$^2$ and 2.3 g/m$^2$, respectively. For the amount of M-10 added per gram of gelatin, see Table 6.

The coated samples were given minus blue exposure (using a sharp cut filter SC 52) through a continuous wedge under a light source having a color temperature of 4,800° K. The exposed samples were developed with a surface developer (for its formulation, see Table 1 in Example 1) at 20° C. for 10 minutes, fixed, rinsed and dried. Thereafter, optical densities on the processed samples were measured and their relative sensitivities are shown in Table 6.

S-1

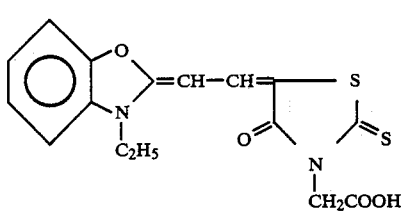

TABLE 6

| Sample No. | Sensitization of A-79 Containing System by M-10: M-1 Added (10-4 gram eq./g gelatin) | Minus Blue sensitivity |
|---|---|---|
| IV-1(comparison) | 0 | 100 |
| IV-2 (the invention) | 2.1 | 112 |
| IV-3 (the invention) | 4.2 | 138 |
| IV-4 (the invention) | 8.4 | 186 |

The above data shows that even in systems containing light-collecting dye A-79, surfactant M-10 is effective for the purpose of increasing their minus blue sensitivity.

EXAMPLE 5

To 23 g of emulsion A prepared in Example 1, 23 g of a 10 wt % gelatin solution, $10^{-5}$ moles of spectral sensitizing dye S-3 having the structural formula shown below, and a varying amount of surfactant M-10 were added. To the mixture, $1.6\times10^{-3}$ moles of light-collecting dye A-1 (whose emission quantum yield at a concentration of 10-4 mol/dm$^3$ in dry gelatin was 0.82) was added, followed by addition of a hardening agent and a coating aid. The resulting coating solutions were applied to a support and dried. The coating weights of silver and gelatin were 1.25 g/m$^2$ and 2.3 g/m$^2$, respectively. For the amount of M-10 added per gram of gelatin, see Table 7.

The coated samples were given minus blue exposure (using a sharp cut filter SC 52) through a continuous wedge under a light source having a color temperature of 4,800° K. The exposed samples were developed with a surface developer (for its formulation, see Table 1 in Example 1) at 20° C. for 10 minutes, fixed, rinsed and dried. Thereafter, optical densities on the processed samples were measured and their relative sensitivities are shown in Table 7.

S-3

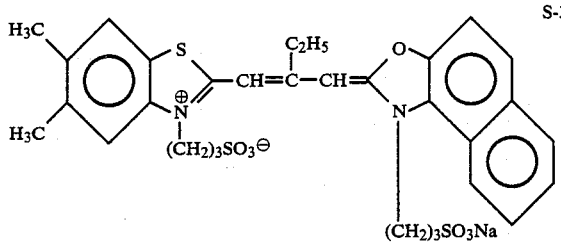

TABLE 7

| Sample No. | Sensitization of A-1 Containing System by M-10: M-1 Added (10−4 gram eq./g gelatin) | Blue sensitivity |
|---|---|---|
| V-1(comparison) | 0 | 100 |
| V-2 (the invention) | 4.2 | 158 |
| V-3 (the invention) | 8.4 | 186 |
| V-4 (the invention) | 12.6 | 191 |

The above data shows that even in systems containing light-collecting dye A-1, the addition of surfactant M-10 contributed to a marked increase in their blue sensitivity.

While the invention has been described in detail and with reference to specific embodiments thereof, it will be apparent to one skilled in the art that various changes and modifications can be made therein without departing from the spirit and scope thereof.

We claim:

1. A silver halide photographic material comprising a support having thereon at least one silver halide emulsion layer containing at least $1.0\times10^{-4}$ gram equivalent of an anionic surface active material as anion per gram of a hydrophilic dispersion medium in said emulsion layer, the photographic material having dispersed in said emulsion layer a water-soluble processing-removable light-collecting dye that has an emission band overlapping at least partially with the optical absorption band of a spectral sensitizing dye on a silver halide grain present in said emulsion layer, said light-collecting dye having an emission quantum yield of at least 0.1 determined at a concentration of $10^{-4}$ mol/dm$^3$ in a dry gelatin medium at room temperature, with the proviso that the light-collecting dye and the spectral sensitizing dye may be the same compound where the light-collecting dye is partly adsorbed onto silver halide grains.

2. A silver halide photographic material as claimed in claim 1, wherein said spectral sensitizing dye is selected form (a) merocyanine dyes, (b) cyanine dyes having at least one of thiazole, selenazole, quinoline, and indolenine nuclei, and (c) cyanine dyes having at least two oxazole nuclei or at least two imidzaole nuclei, the basic heterocyclic nuclei in the cyanine dyes optionally having an alicyclichydrocarbon ring and/or an aromatic hydrocarbon ring fused thereto.

3. A silver halide photographic material as claimed in claim 1, wherein said light-collecting dye dispersed in a hydrophilic dispersion medium has a water solubility of at least $10^{-2}$ mol/l at 25° C. and at a pH of 7.0.

4. A silver halide photographic material as claimed in claim 1, wherein said light-collecting dye dispersed in a hydrophilic dispersion medium has an adsorption at equilibrium on a {III} face of a silver bromide grain of up to $10^{-6}$ mol/m$^2$ per unit surface area of AgBr grains at 40° C., a pH of $6.5\pm0.5$ and at a dye concentration of $10^{-4}$ mol/l solution phase.

5. A silver halide photographic material as claimed in claim 1, wherein said light-collecting dye has an emission quantum yield of at least 0.3.

6. A silver halide photographic material as claimed in claim 5, wherein said light-collecting dye has an emission quantum yield of at least 0.5.

7. A silver halide photographic material as claimed in claim 1, wherein said light-collecting dye has a maximum absorption wavelength of from 420 nm to 740 nm.

8. A silver halide photographic material as claimed in claim 1, wherein said light-collecting dye is present in a concentration of at least $2\times10^{-3}$ mol/dm$^3$.

9. A silver halide photographic material as claimed in claim 8, wherein said light-collecting dye is present in a concentration of at least $10^{-2}$ mol/dm$^3$.

10. A silver halide photographic material as claimed in claim 8, wherein said light-collecting dye is present in a concentration of not more than $10^{-1}$ mol/dm$^3$.

11. A silver halide photographic material as claimed in claim 1, wherein said light-collecting dye is a water-soluble cyanine dye containing at least three sulfo groups and/or carboxyl groups.

12. A silver halide photographic material as claimed in claim 11, wherein said light-collecting dye has an emission quantum yield of at least 0.5.

13. A silver halide photographic material as claimed in claim 1, wherein said light-collecting dye has a maximum emission wavelength which does not exceed the maximum absorption wavelength of a spectral sensitizing dye having the longest absorption wavelength of the spectral sensitizing dyes adsorbed on the silver halide grains.

14. A silver halide photographic material as claimed in claim 1, wherein said light-collecting dye has a Stokes' shift of emission within 40 nm in dry gelatin at a concentration of $10^{-4}$ mol/dm$^3$ at room temperature.

15. A silver halide photographic materials as claimed in claim 14, wherein said light-collecting dye has a Stokes' shift of emission within 20 nm.

16. A silver halide photographic material as claimed in claim 1, wherein said light-collecting dye has a reduction potential more anodic than $-1.0$V with reference to a saturated calomel electrode in a water/ethanol (1:1 by volume) solution.

17. A silver halide photographic material as claimed in claim 1, wherein said anionic surface active material is present in an amount of at least $3.0\times10^{-4}$ gram equivalents as anion per gram of the hydrophilic dispersion medium.

18. A silver halide photographic material as claimed in claim 1, wherein said anionic surface active material is water-soluble and dissolves in an amount of at least 5% by weight in an aqueous medium at room temperature.

* * * * *